United States Patent [19]

Tellas

[11] Patent Number: 5,027,967

[45] Date of Patent: Jul. 2, 1991

[54] RAPID DEPLOYMENT APPARATUS

[76] Inventor: Charles F. Tellas, 3121 Judd Rd., Milan, Mich. 48160

[21] Appl. No.: 491,307

[22] Filed: Mar. 9, 1990

[51] Int. Cl.[5] ..... B65D 25/28; B65D 55/00

[52] U.S. Cl. ..... 220/264; 190/118; 206/316.2; 206/317

[58] Field of Search ..... 150/107; 190/16, 106, 190/114, 118, 119, 100, 900; 206/316.1, 317, 316.2, 1.5; 220/262-264, 335

[56] References Cited

U.S. PATENT DOCUMENTS

| | | | |
|---|---|---|---|
| 403,029 | 5/1889 | Barrett | 190/118 |
| 448,139 | 3/1891 | Mayer | 190/106 |
| 2,483,304 | 9/1949 | Vogel | 220/264 |
| 2,557,048 | 6/1951 | Haase | 220/335 |
| 2,706,036 | 4/1955 | Neal | 206/317 |
| 2,781,897 | 2/1957 | Dale | 206/317 |
| 3,034,551 | 5/1962 | Klehr | 190/106 |
| 3,369,721 | 2/1968 | Lentz | 206/317 |
| 4,119,199 | 10/1978 | Whitaker, Jr. | 206/317 |
| 4,513,877 | 4/1985 | Taguchi et al. | 220/335 |
| 4,721,205 | 1/1988 | Burt et al. | 206/317 |

FOREIGN PATENT DOCUMENTS

| | | | |
|---|---|---|---|
| 0016449 | 6/1904 | Austria | 190/118 |

*Primary Examiner*—Jimmy G. Foster
*Attorney, Agent, or Firm*—James E. Brunton

[57] ABSTRACT

An apparatus for transporting a utilitarian object such as a weapon, camera, or the like in a concealed manner which includes a deployment mechanism that can be easily activated to instantly deploy the object for use. The apparatus includes an enclosure which in its normal transport mode has the appearance of an attache case. The utilitarian object is concealed within the attache case until the deployment mechanism is actuated causing the attache case to fall away from the utilitarian object readying it for use.

12 Claims, 4 Drawing Sheets

43
46
44
42
28
52
40
38
17a
34
34a
17
54
17b
49
19
-16-
47
48
22
24
54
52
50
30a
51
18b
53
18a
36a
36
38
18

12
17a
5
17
14
6
38
34
34a
52
40
30
16
49
46
44
42
45
54
17b
43
47
48
24
22
28
36a
50
30a
-20-
53
51
19
38
36
52
18a
18
18b

RAPID DEPLOYMENT APPARATUS

BACKGROUND OF THE INVENTION

Field of the Invention

The present invention relates generally to apparatus for transporting utilitarian objects such as weapons, cameras, and electronic devices in a concealed manner and then for rapidly deploying the objects for use. More particularly the invention concerns a transportable enclosure, such as an attache case, which normally conceals the utilitarian object, but is designed to rapidly separate from the object in an emergency situation making the object immediately available for use.

DISCUSSION OF THE INVENTION

Introduction

Law enforcement agencies frequently have a need to transport items such as weapons, cameras, light sources and electronic devices in a concealed manner. In the past, specially designed suitcases and briefcases of various configurations have fulfilled this need. However, such devices are typically difficult and time consuming to open in emergency situations. For example, if the object to be transported is a weapon, the excessive time required to set the briefcase down, open it, remove the weapon and to bring it into a firing position is unacceptable in most emergency situations. The thrust of the present invention is to overcome this deficiency by providing a uniquely designed enclosure for carrying a weapon or other article in a concealed manner and then through operation of a simple deployment mechanism, instantly deploy the article for use.

SUMMARY OF THE INVENTION

It is an object of the present invention to provide an apparatus for transporting a utilitarian object such as a weapon, camera, or the like in a concealed manner, which includes a deployment mechanism that can be easily activated to instantly deploy the object for use.

Another object of the invention is to provide an apparatus of the aforementioned character which, in its normal transport mode, has the appearance of an attache case.

Another object of the invention is to provide an apparatus as described in the preceding paragraph, in which the deployment mechanism is concealed within the carrying handle of the attache case and in which the utilitarian object is connected to the handle.

Still another object of the invention is to provide an apparatus of the character described in which activation of the deployment mechanism causes the side portions of the attache case to instantly fall away from the handle thereby exposing the utilitarian object.

Yet another object of the invention is to provide an apparatus as described in the preceding paragraphs which is compact, light weight, reliable and easy to use in emergency situations.

DESCRIPTION OF THE INVENTION

Figure 1:
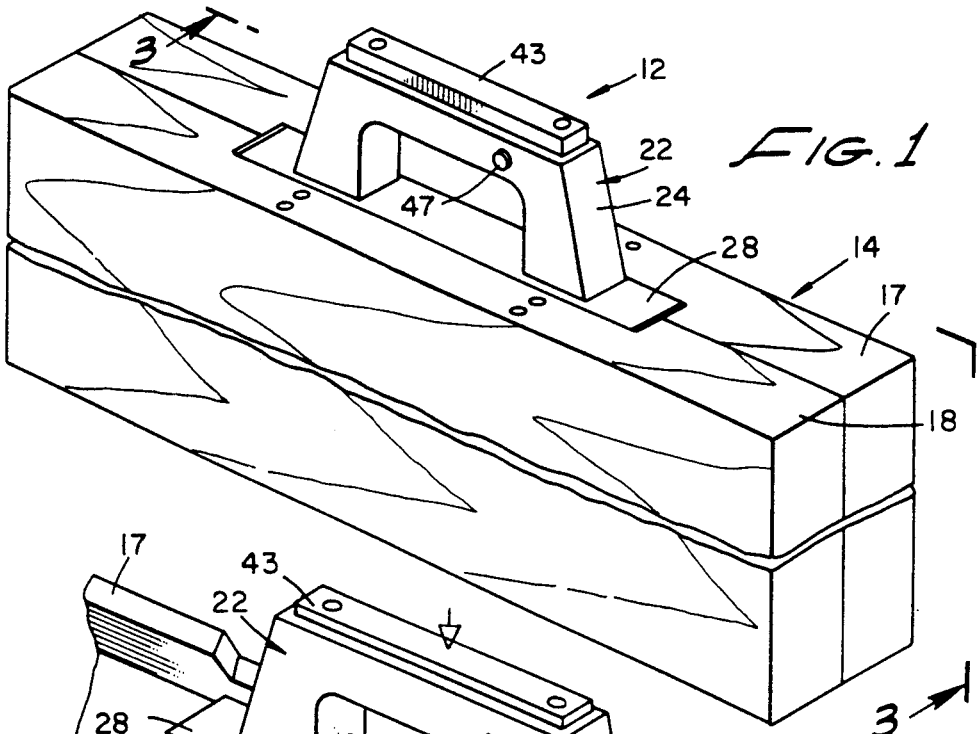
FIG. 1 is a generally perspective view of the apparatus of the invention.
Figure 2:
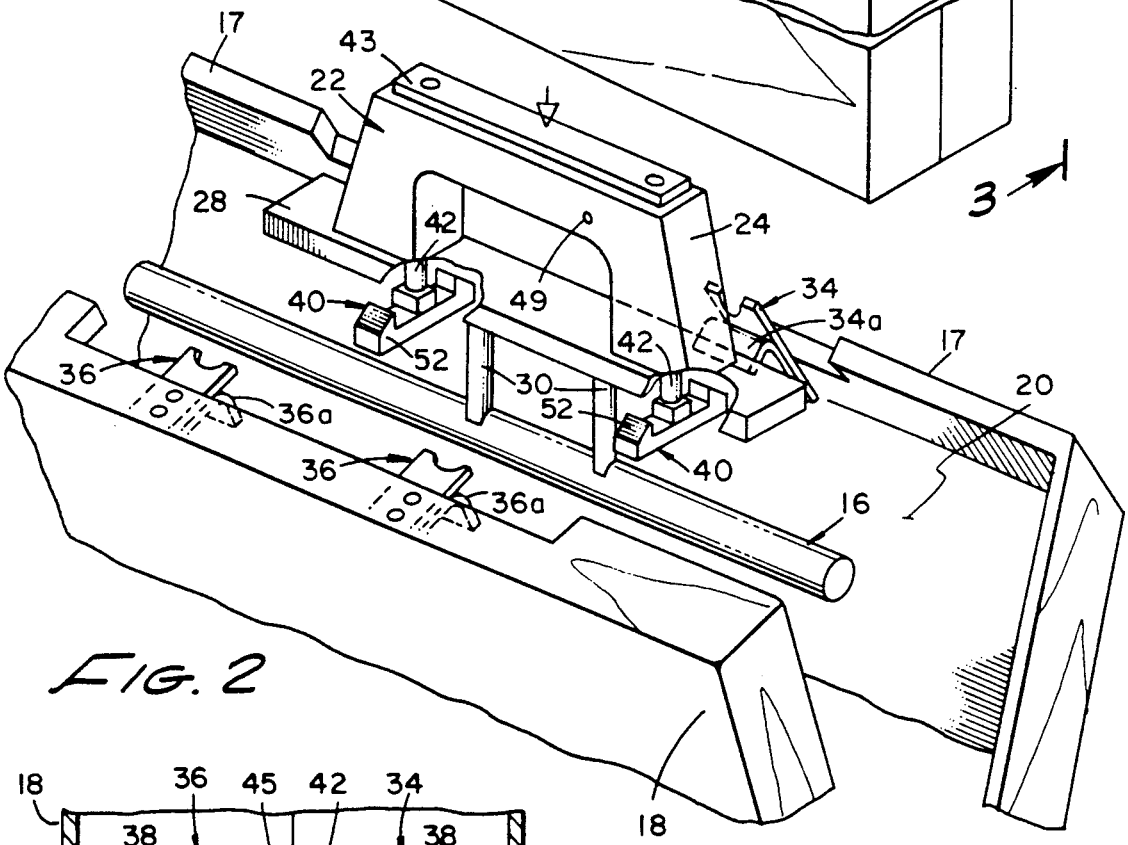
FIG. 2 is a fragmentary generally perspective view illustrating the apparatus of FIG. 1 in a partially open configuration.
Figure 3:
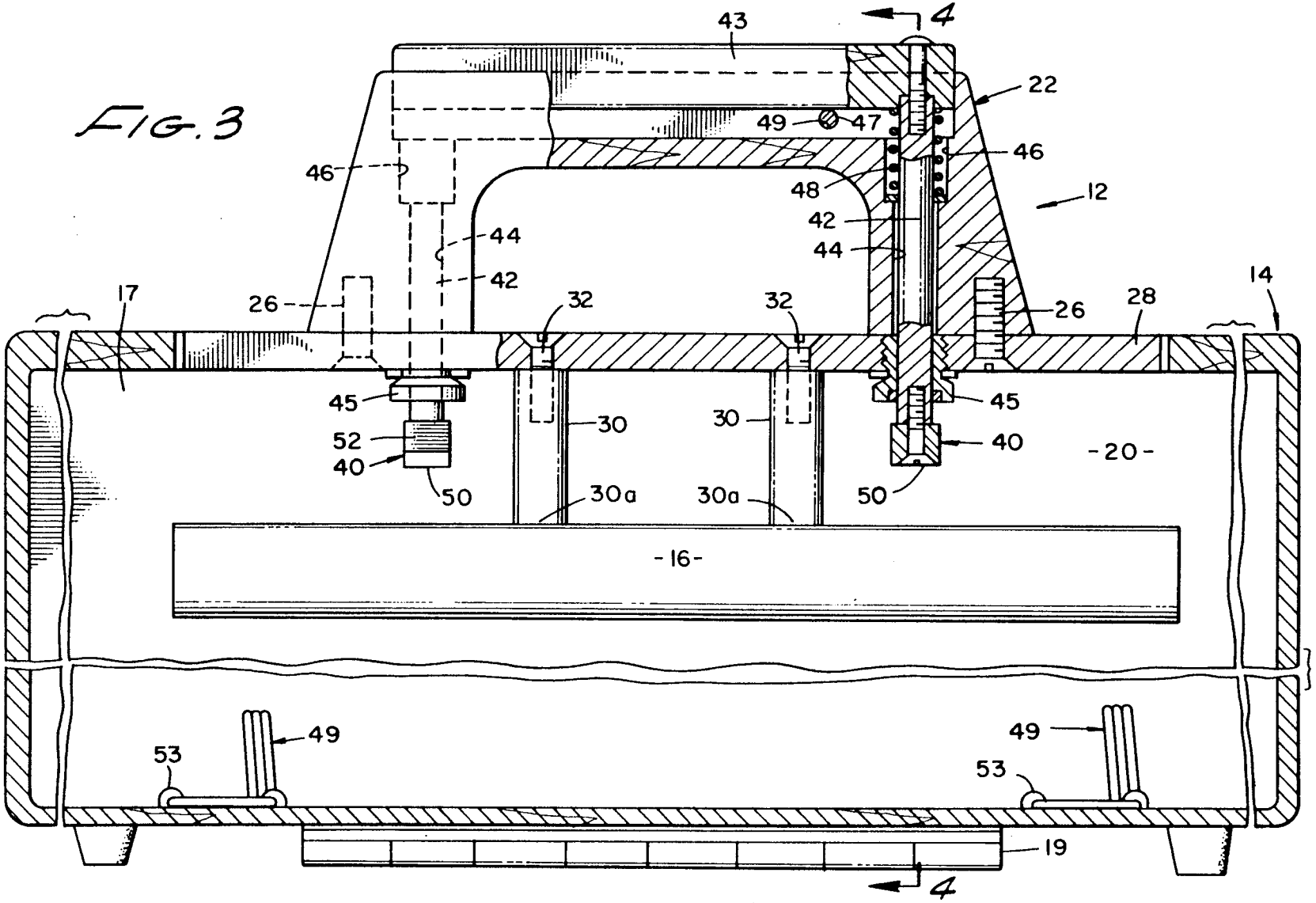
FIG. 3 is an enlarged view partly in cross-section taken along lines 3—3 of FIG. 1.

Referring to the drawings and particularly to FIGS. 1, 2, and 3 one form of the rapid deployment apparatus of the present invention for concealing and then rapidly deploying for use a utilitarian object such as weapon, camera, electronic device or like object is generally designated by the numeral 12. The apparatus comprises a portable enclosure 14 for enclosing the utilitarian object 16 (FIGS. 2 and 3), which enclosure includes first and second hingeably connected portions 17 and 18 movable from a first closed position, shown in FIG. 1, to a second open position shown in FIG. 2. Portions 17 and 18 are interconnected by a hinge assembly 19 of conventional construction. When the enclosure 14 is in its first position, first and second portions 17 and 18 cooperate to define an internal chamber 20 for concealing the object 16. As best seen by referring to FIG. 2, when enclosure 14 is in the second open position, the enclosure is free to fall away from the object 16 making it immediately available for use.

To releasably secure first and second portions 17 and 18 of enclosure 14 in the first position shown in FIG. 1, securement means of unique construction are provided. Operably associated with the securement means are deployment means for causing the first and second portions of the enclosure 14 to rapidly move from the closed position to the open position shown in FIG. 2.

Figure 4:
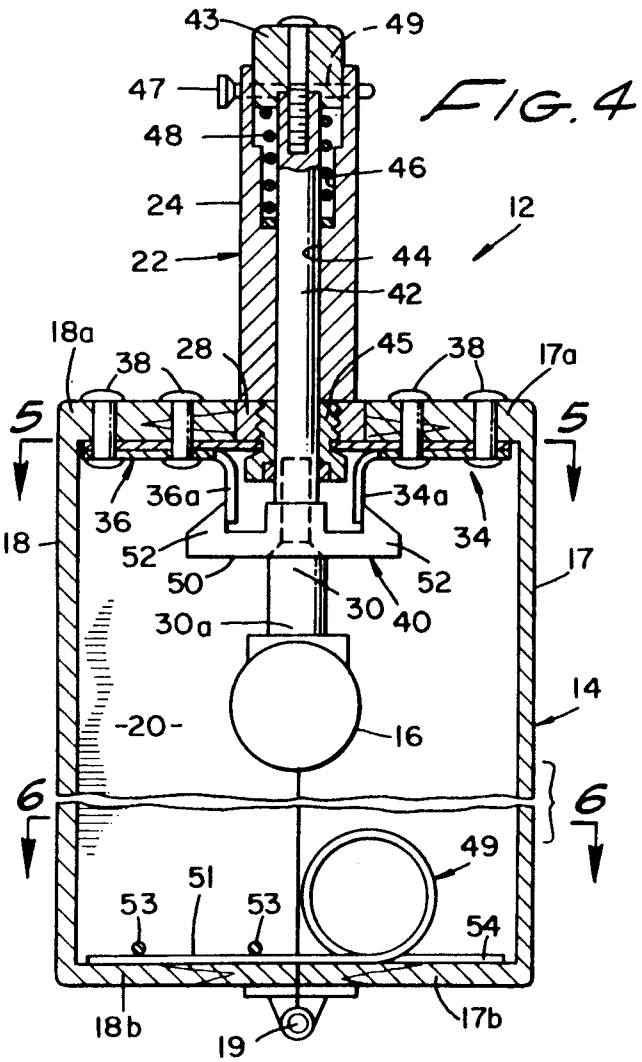
FIG. 4 is a cross-sectional view taken along lines 4—4 of FIG. 3.

As can be seen by also referring to FIG. 4, the deployment means of the present form of the invention includes means for carrying enclosure 14 shown here as a handle assembly 22. Handle assembly 22 comprises a U-shaped gripping handle 24 which is affixed by suitable fasteners 26 to a generally planer shaped base member 28. Forming a part of handle assembly 22 is adapter means for interconnection with the utilitarian object 16. In the form of the invention shown in the drawings, the adapter means comprise a pair of downwardly depending support rods 30 which are connected at their upper ends to plate 28 by means of appropriate fasteners 32. Utilitarian object 16 is interconnected in an appropriate fashion with support members 30 proximate their lower ends **30*a***.

Referring particularly to FIGS. 2 and 4, the securement of the present embodiment of the invention comprises a pair of longitudinally spaced-apart first latching elements 34 connected to an upper wall **17*a* of first enclosure portion 17 and a second pair longitudinally of spaced-apart latching elements 36 connected to an upper wall 18*a* of second enclosure portion 18. Each of the latching elements 34 and 36 include a first generally horizontally extending portion which is interconnected with walls 17***a* and 18*a* by suitable fasteners such as rivets 38 and a second downwardly depending portion designated in the drawings by the numerals 34*a* and 36*a* respectively. Also comprising a portion of the securement means is a pair of third latching elements 40 connected proximate the lower ends of a pair of cylindrically shaped connectors members 42 which form a part of handle assembly 22. Mounted proximate the upper ends of members 42 is an actuating bar 43, the purpose of which will presently be described.

Figure 5:
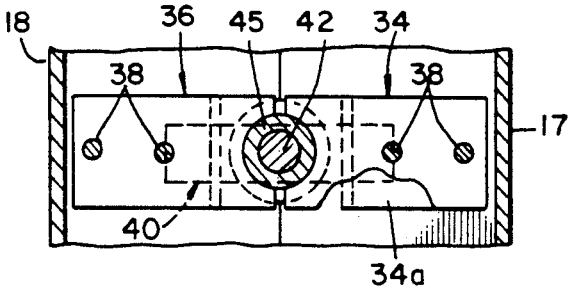
FIG. 5 is a cross-sectional view taken along lines 5—5 of FIG. 4.

Connector members 42 are telescopically movable within bores 44 provided in handle 24 from a first raised position to a second depressed position. Carried within counterbores 46 provided in the upper portion of handle 24 are coiled springs 48, which function to yieldably maintain actuating bars 43 in the first raised position shown in FIGS. 1 and 4. Guide plugs 45 are threadably receivable within base 28 to guide telescope movement of connector members 42 within bores 44. (FIG. 5).

As best seen in FIG. 4, each of the third latching elements 40 comprises a horizontally extending base portion 50 having upwardly extending, transversely spaced, hook-like portions 52 provided at either end. With this construction, when actuating bar 43 is held in its normal upward position as shown in FIGS. 3 and 4, hook-like elements 52 of the third latching element 40 engage downwardly depending portions 34*a* and 36*a* of first latching elements 34 and 36 so as to hold enclosure 14 in the closed position illustrated in FIGS. 1 and 4. However, a downward force exerted against actuating bar 43 against the urging of springs 46 will cause the third latching elements 40 to move downwardly within container 14 into the position shown in FIG. 7. In this position, hook-like end portions 52 will clear downwardly depending portions 34*a* and 36*a* of the second latching elements enabling the biasing means of the invention, the nature of which will presently be disclosed, to move the first and second portions 17 and 18 of container 14 into the open position shown in FIG. 7. As the enclosure moves to the open position it will fall downwardly away from handle 24 by force of gravity thereby exposing article 16 for use. A removable locking pin 47 is receivable within a bore 49 provided in the handle and the actuating bar to prevent accidental depression of the actuating bar (FIGS. 4 and 7).

Figure 7:
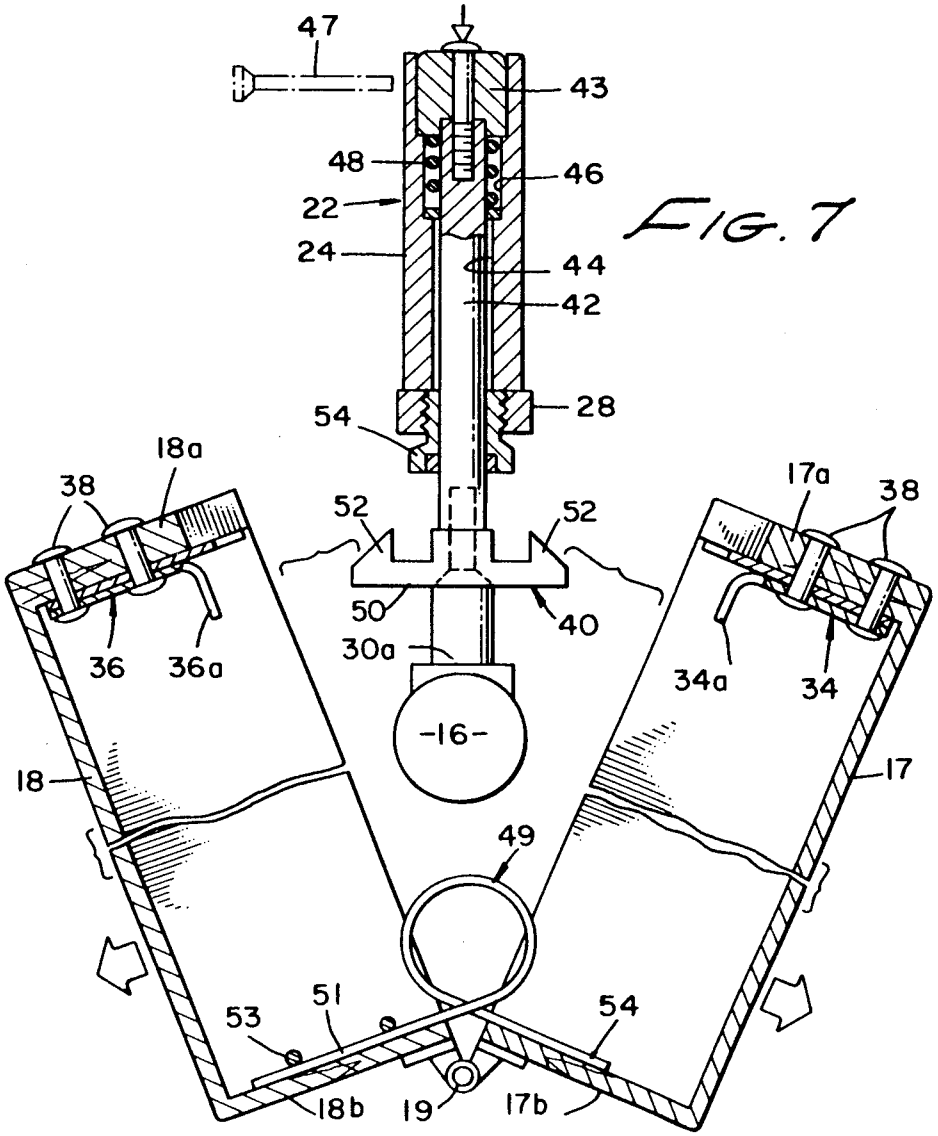
FIG. 7 is a cross-sectional view similar to FIG. 4 but showing the apparatus of the invention in a deployed configuration.

An important aspect of the present invention is biasing means mounted within enclosure 14 for acting upon the first and second portions of the enclosure to cause the portions to move rapidly toward the open or second position shown in FIG. 7. In the present embodiment of the invention, the biasing means comprises a part of the deployment means and includes spring means mounted interiorly of the enclose for continuously urging the first and second portions of the enclosure to move into the second position. The biasing means can take several forms including a yieldably deformable encapsulating member which encapsulates the article 16 and is compressed against the first and second portions of the enclosure as the enclosure is moved into the closed position. This member which will be discussed further in connection with the form of the invention shown in FIGS. 8 and 9 can be constructed of a deformable resilient material such as a natural or synthetic rubber which, when the enclosure is closed, continuously exerts a pressure against the first and second portion 17 and 18 of the enclosure tending to move them toward the second open position. The biasing means must act with sufficient force to assure that both portions of the enclosure 14 separate sufficiently to clear object 16 and fall freely away by force of gravity.

Figure 6:
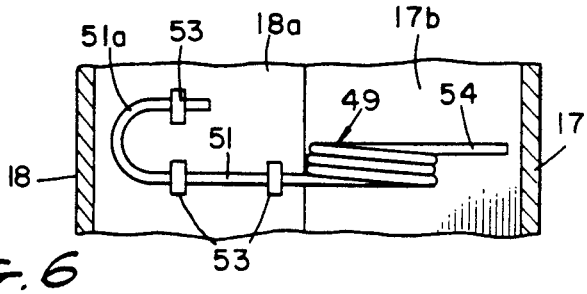
FIG. 6 is a cross-sectional view taken along lines 6—6 of FIG. 4.

Another suitable form of biasing means comprises a torsion spring 49 of the character illustrated in the drawings. Referring particularly to FIGS. 4 and 7, this torsion spring comprises a first leg, or portion, 50 which is connected to the floor 18*b* of portion 18 of container 14. As shown in FIG. 6, leg 50 includes a U-shaped portion 50*a* which is secured to floor 18*b* by appropriate fasteners 52. Torsion spring 49 also includes a second leg, or portion, 54 which is disposed within first portion 17 of container 14 and acts upon the floor 17*b* thereof in the manner illustrated in FIG. 7 to urge pivotal movement of portions 17 and 18 of the container about hinges 19. It is to be understood that other types of spring construction and other biasing devices of a character well known to those skilled in the art can be used to urge pivotal separation of portions 17 and 18 of the container as the securement means moves into its second lower position as shown in FIG. 7.

Figure 9:
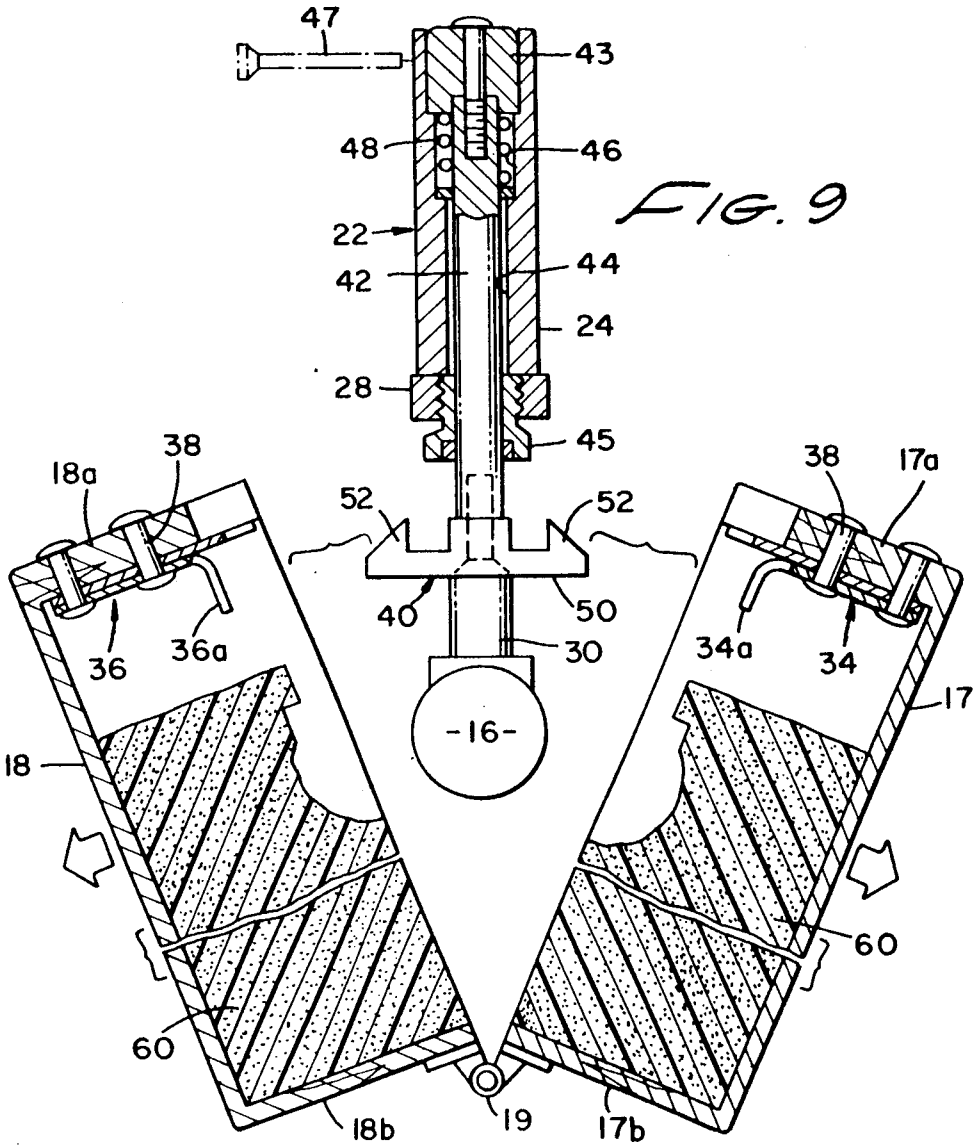
FIG. 9 is a cross-sectional view similar to FIG. 7 showing the alternate form of the invention in a deployed configuration.
Figure 8:
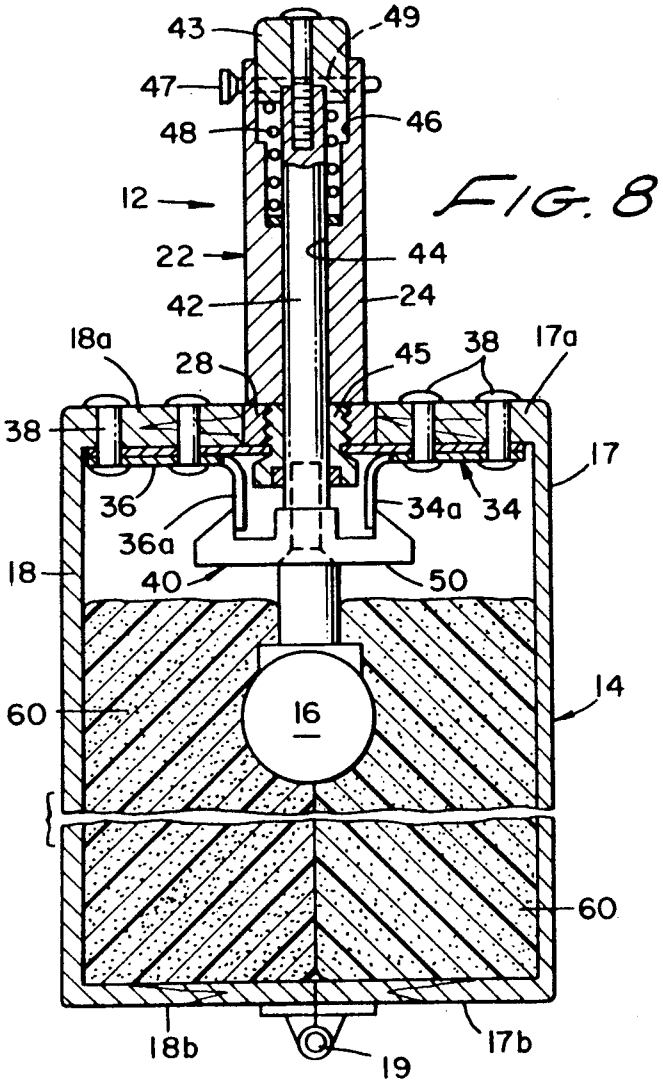
FIG. 8 is a cross-sectional view similar to FIG. 4 but showing an alternate form of the invention.

Turning now to FIGS. 8 and 9, an alternate form of the invention is there shown. Most of the components of this embodiment are identical to those of the form of the invention previously described and like numerals are used to identify like components. The primary difference between this second form of the invention and the form earlier described is that the biasing means for acting upon the first and second portions of the enclosure to force them apart comprises a compressible synthetic foam rubber material 60 which encapsulates the utilitarian object 16. As the first and second portions of the enclosure 14 are moved into the configuration shown in FIG. 8, the foam material is compressed about the article 16 and acts upon the sidewalls of the enclosure to continuously urge them toward the second open position shown in FIG. 9.

The material 60, is constructed and arranged so that as the latching element 50 moves into the position shown in FIG. 9, substantial forces are exerted on the sidewalls of the enclosure to assure the complete separation of the enclosure so that upper walls 17*a* and 18*a* will not come to rest on the object 16, but rather will cleanly fall away by force of gravity. The material 60 can be any type of compressible foam, natural or synthetic rubber, or material of similar function. As indicated in FIGS. 8 and 9, the material is preferably constructed in two mating halves and securely encapsulates the object 16 in the transport mode of the apparatus. The material 60 thus performs two functions, namely to protect the utilitarian article and to act as a biasing means to positively and cleanly separate the two halves of the enclosure 14 in the manner shown in FIG. 9.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A rapid deployment apparatus for concealing and then rapidly deploying for use a utilitarian object comprising:

(a) an enclosure for enclosing the utilitarian object including operably associated first and second portions movable between a first position defining an internal chamber for concealing the object and a second position deploying the object for use;

(b) securement means interconnected with said enclosure for releasably maintaining said first and second portions thereof in said first position;

(c) deployment means operably associated with said securement means for interaction with said securement means for moving said first and second portions to said enclosure from said first closed to said second open position, said deployment means comprising a handle assembly releasably connected to said enclosure.

2. An apparatus as defined in claim 1 in which said deployment means includes means for carrying said enclosure.

3. An apparatus as defined in claim 1 in which said deployment means further includes adapter means for interconnection with the utilitarian object.

4. An apparatus as defined in claim 1 in which said deployment means further includes biasing means mounted within said enclosure for acting upon said first and second portions of said enclosure to cause said portions to move rapidly toward said second position.

5. An apparatus as defined in claim 4 in which said biasing means comprises a compressible material contained interiorly of said enclosure for continuously urging said first and second portion of said enclosure to move from said first to said second position.

6. An apparatus as defined in claim 4 in which said biasing means comprises a spring mounted interiorly of said enclosure for continuously urging said first and second portions of said enclosures to move from said first to said second position.

7. An apparatus as defined in claim 6 in which said spring means comprises a torsion spring having a first portion engaging said first portion of said container and a second portion engaging said second portion of said container.

8. A rapid deployment apparatus for concealing and then exposing an utilitarian object, comprising:

(a) an enclosure for enclosing the utilitarian object, including:

(i) a first portion; and (ii) a second portion hingeably connected to said first portion, said first and second portions being movable between a first position defining an internal chamber for concealing the utilitarian object and a second position exposing the utilitarian object;

(b) securement means connected to said enclosure for maintaining said first and second portions thereof in said first position; and (c) deployment means connected to said enclosure and operably associated with said securement means for interaction with said securement means to permit said first and second portions of said enclosure to move toward said second position, said deployment means including biasing means mounted within said enclosure for continuously urging said first and second portions to move toward said second position, said deployment means comprising a handle assembly releasably connected to said enclosure.

9. An apparatus as defined in claim 8 in which said handle assembly includes a connector member telescopically movable within said handle and a third latching element connected to said connector members for releasably interconnecting said first and second latching elements.

10. An apparatus as defined in claim 9 in which said handle assembly includes actuating means connected to said connector member for moving said third latching element from a first position in engagement with said first and second latching elements to a second position spaced apart from said first and second latching elements.

11. An apparatus as defined in claim 10 in which said actuating means includes spring means for yieldably resisting movement of said third latching element toward said second position.

12. An apparatus as defined in claim 11 in which said spring means comprises a coil spring mounted internally of said handle for engagement with said actuating means.

* * * * *